United States Patent [19]

Hirschberger

[11] 4,058,360

[45] Nov. 15, 1977

[54] SELF-FEATHERING PROPELLER

[76] Inventor: Carl R. Hirschberger, Laurel Ave., Brielle, N.J. 08730

[21] Appl. No.: 690,577

[22] Filed: May 27, 1976

[51] Int. Cl.[2] ..... B63H 1/20

[52] U.S. Cl. ..... 416/140; 416/169 R

[58] Field of Search ..... 416/140, 131, 134, 169

[56] References Cited

U.S. PATENT DOCUMENTS

| | | | |
|---|---|---|---|
| 1,520,746 | 12/1924 | Boyce et al. | 416/140 |
| 1,600,654 | 9/1926 | Stodder | 416/140 |
| 1,718,525 | 6/1929 | Casey | 416/140 |
| 2,134,157 | 10/1938 | Thompson | 416/140 |
| 2,257,976 | 10/1941 | Moorman | 416/131 |
| 2,283,774 | 5/1942 | Thompson | 416/140 |
| 2,322,352 | 6/1943 | Frazier | 416/140 |
| 2,417,917 | 3/1947 | Everts | 416/131 |

FOREIGN PATENT DOCUMENTS

| | | | |
|---|---|---|---|
| 5,245 of | 1881 | United Kingdom | 416/140 |

*Primary Examiner*—Everette A. Powell, Jr.
*Attorney, Agent, or Firm*—Rudolph J. Jurick

[57] ABSTRACT

A self-feathering propeller for use on sail boats having an auxiliary power source. The propeller blades are rotated automatically to working pitch positions to provide an ahead or an astern thrust in accordance with the direction of rotation of the propeller shaft. When the shaft is stationary and water flow is substantially parallel to the shaft axis, as when the boat is under sail, the blades are automatically feathered thereby to minimize resistance to movement of the boat.

7 Claims, 5 Drawing Figures

SELF-FEATHERING PROPELLER

BACKGROUND OF THE INVENTION

In self-feathering propellers used on auxiliary powered vessels the blades are constructed and arranged for limited rotation about individual axes normal to the axis of the propeller shaft. Various constructions of such propellers have been proposed heretofore.

In J. M. Casey U.S. Pat. No. 1,718,525, June 25, 1929, the propeller blades are journaled on eccentric axes in a split casing which is attached to the propeller shaft. The blades are provided with flanged base portions which serve as bearing surfaces and the blades are rotated about their axes by cooperating lugs and helical ribs provided on the flanged base portions and the shaft. Such blade-base-bearings, generally referred to as "table bearings" are notoriously troublesome when the load is applied at some distance from the bearing surfaces.

In M. D. Thompson U.S. Pat. Nos. 2,134,157, Oct. 25, 1938, and 2,283,774, May 10, 1942, the blades also are provided with flanged base portions serving as bearing surfaces. The blades are rotated about their axes by means of lugs extending from the base portions and slidably received in helical grooves formed in the peripheral surface of the propeller shaft.

In the prior devices, the propeller blades are rotated about their axes to working pitch positions by mechanical force. The operating principle is that of a cam and cam follower, requiring precision machining of the co-acting parts. In general, the prior devices are complex and costly and have a low reliability factor.

A self-feathering propeller made in accordance with this invention requires a minimum number of simple, sturdy parts which are loosely fitted together to provide an operative assembly.

SUMMARY OF THE INVENTION

The propeller blades are loosely supported by and rotatable about individual spindles extending radially from a sleeve member which is rotatable about a hub secured to the propeller shaft. The hub carries pintles which serve to transmit torque from the shaft to the sleeve member. The pintles also position the blades for reverse thrust when the shaft is rotated in the astern direction. Stops extending from the sleeve member serve to limit the rotation of the blades to provide a forward thrust when the propeller shaft is rotated in the ahead direction.

An object of this invention is the provision of a self-feathering propeller for use on an auxiliary powered vessel, which propeller is of simple, sturdy and economical construction, and which has a high reliability factor.

An object of this invention is the provision of a self-feathering propeller in which the blades are supported by and loosely rotatable about individual spindles extending radially from a sleeve member rotatable by the propeller shaft.

An object of this invention is the provision of a self-feathering propeller in which water pressure causes the blades to assume proper pitch position for imparting a forward thrust.

The above stated and other objects and advantages of the invention will become apparent from the following description when taken with the accompanying drawings. It will be understood, however, that the drawings are for purposes of illustration and are not to be construed as defining the scope or limits of the invention, reference being had for the latter purpose to the claims appended hereto.

BRIEF DESCRIPTION OF THE DRAWINGS

In the drawings wherein like reference characters denote like parts in the several views.

DESCRIPTION OF THE PREFERRED EMBODIMENT

Figure 1:
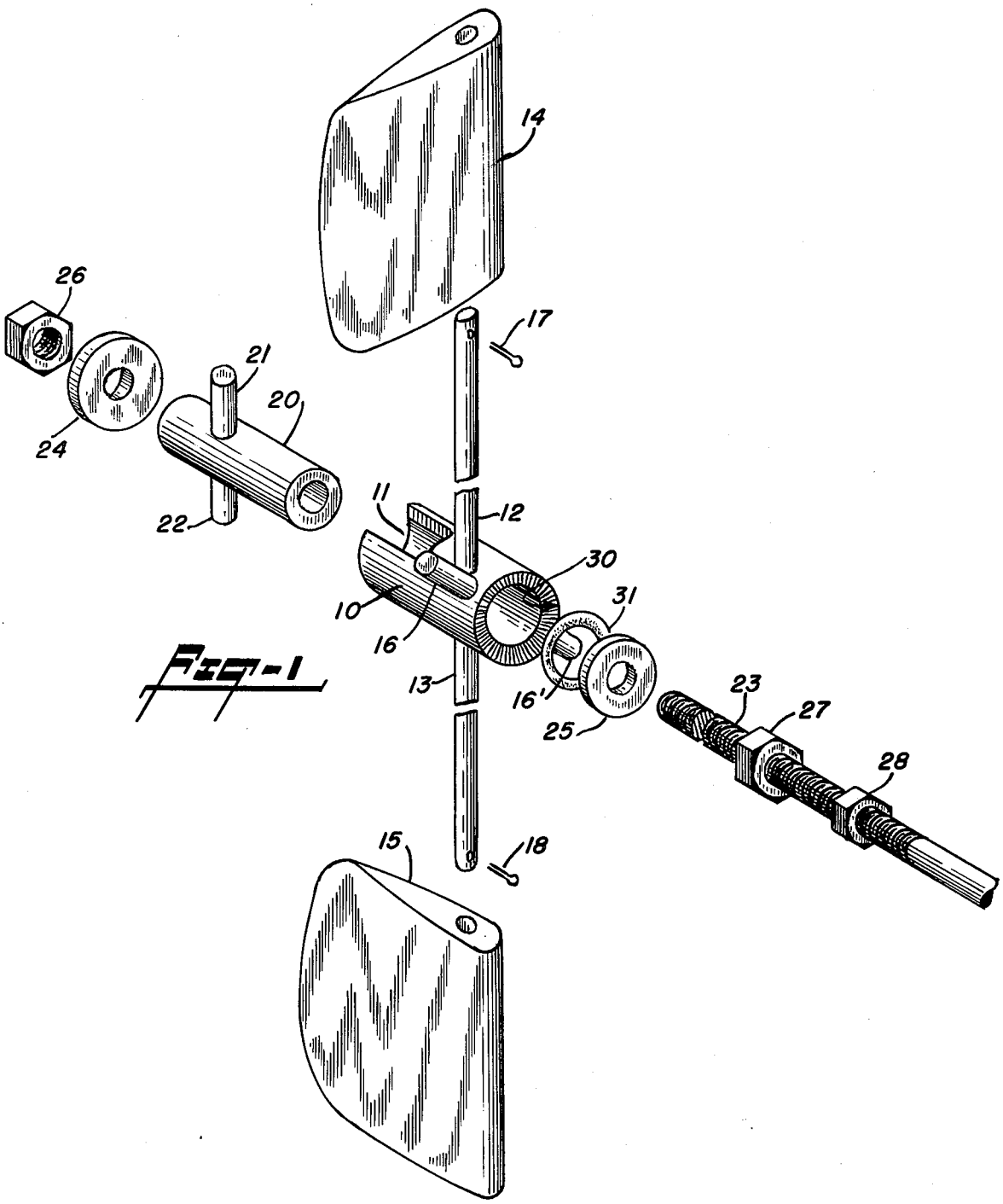
FIG. 1 is an exploded, isometric view showing the parts of a self-feathering propeller made in accordance with one embodiment of this invention.

Referring to FIG. 1, the propeller comprises a sleeve member 10 provided with diametrically-opposed end slots, only the upper slot 11 being visible in this particular view. Secured to the sleeve member are a pair of spindles 12 and 13 which extend normal to the axis of the sleeve member or, alternatively, are raked slightly aft. The spindles are loosely slidable through clearance holes formed in the blades 14 and 15, said blades being so configured that the holes for the spindles lie in the blades leading edge region, whereby a greater blade area constitutes the trailing portion of the blade. The blade profiles and cross-sections may be of various shapes depending upon the intended usage and loading of the particular propeller. Although the blades are freely rotatable about the axes of the supporting spindles, the extent of such rotation in one direction is limited by a pair of stops 16 and 16' carried by the sleeve member. A pair of cotter pins 17 and 18 retain the blades on the spindles.

A hub 20 is slidably positionable within the sleeve member 10 and carries diametrically-opposed pintles 21 and 22. These pintles extend through the longitudinal slots formed in the sleeve member when the hub is positioned within the sleeve member, said pintles being long enough to overlap and abut the blade surfaces. The threaded end of a propeller shaft 23 is slidable through the central hole of the hub, said hub being retained within the sleeve member by means of the washers 24 and 25 and the nuts 26, 27 and 28. An end of the sleeve member is provided with a chamfer 30 which accommodates an O-ring 31. In the assembled propeller, the washer 25 compresses the O-ring between the sleeve member and the hub. Thus, the O-ring functions as a friction clutch while the pintles 21 and 22 serve as torque transmitters to rotate the sleeve member spindles in correspondence with shaft rotation.

Figure 2:
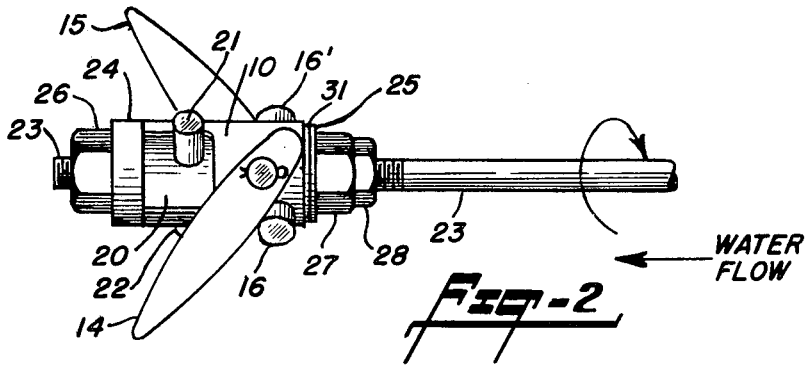
FIG. 2 is a top plan view showing the positioning of the propeller blades when the propeller shaft is rotated in the ahead direction.
Figure 3:
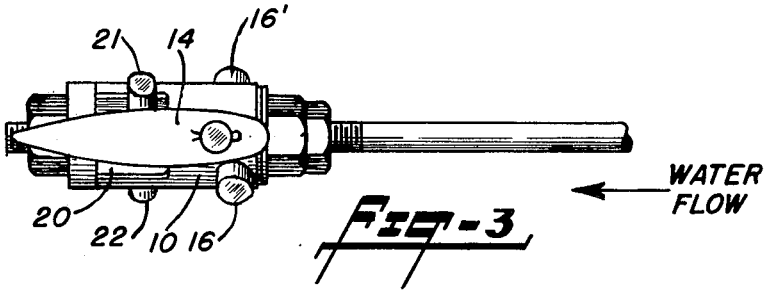
FIG. 3 is a similar view but showing the blades in the feathered positions.

Referring now to FIG. 2, when the propeller shaft 23 is rotated in the indicated direction, the pintles 21 and 22 engage walls of the slots formed in the sleeve member 10, thereby rotating the sleeve member and the blades 14 and 15 in a corresponding direction. Since the blade-supporting spindles lie near the leading edges of the blades, the blades tend to trail and abut against the stops 16 and 16'. These stops are located so that the blades assume proper pitch position to provide a forward thrust to the boat. When the propeller shaft is stationary and water flows parallel or nearly parallel to the shaft axis, because of movement of the boat under sail, the trailing edges of the blades causes them to stream, or feather, as shown in FIG. 3. The blades, being loosely fitted to the supporting spindles, offer very low resistance to rotation about the spindle axes and, thus, they readily assume a feathering attitude.

Figure 4:
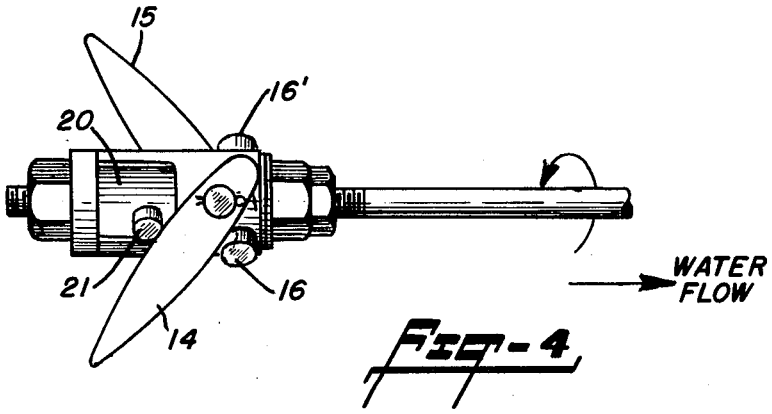
FIG. 4 is a similar view showing the positioning of the blades when the shaft is rotated in the astern direction.

When the propeller shaft is rotated in the astern direction, as shown in FIG. 4, the sequence of operation is as follows. The hub pintles engage the opposite side walls defining the slots in the sleeve member 10 and thereby impart astern rotation to the sleeve member and the blades. As the hub pintles traverse the slots they abut the blade surfaces and force the blades into proper pitch position to provide an astern thrust.

When the blades are feathered as shown in FIG. 3, the shaft being idle and the craft moving ahead, most blade cross sections result in the blades assuming a streaming position angled several degrees to the water flow lines. This is caused by the well-known Bernoulli effect, with a lower pressure on the cambered side of the foil. The angled blades would case the sleeve member 10 to rotate in the flow lines and thus cause the blades to be locked into working pitch positions, thereby resulting in the loss of the advantages to be gained by blade feathering. This action, known as the Flettner effect, is avoided in the described propeller by provision of a frictional coupling, or clutch drag, between the sleeve member and the hub by means of the compressed O-ring 31. The clutch torque preventing relative rotation between the sleeve member and the hub must be greater than the torque developed as a result of the Flettner effect. However, tests demonstrate that only a modest restraining clutch torque is needed, that is, of the order of only a small fraction of the torque transmitted by the propeller shaft.

For feathering the blades it is necessary that the propeller be operated in the ahead direction prior to stopping the propeller shaft. By stopping the propeller shaft while the propeller is rotating in the ahead direction, the pintles of the hub remain in engagement with the side walls of the slots formed in the sleeve member, as shown in FIG. 2. This permits unobstructed rotation of the blades about their individual axes to the feathered positions as shown in FIG. 3.

Figure 5:
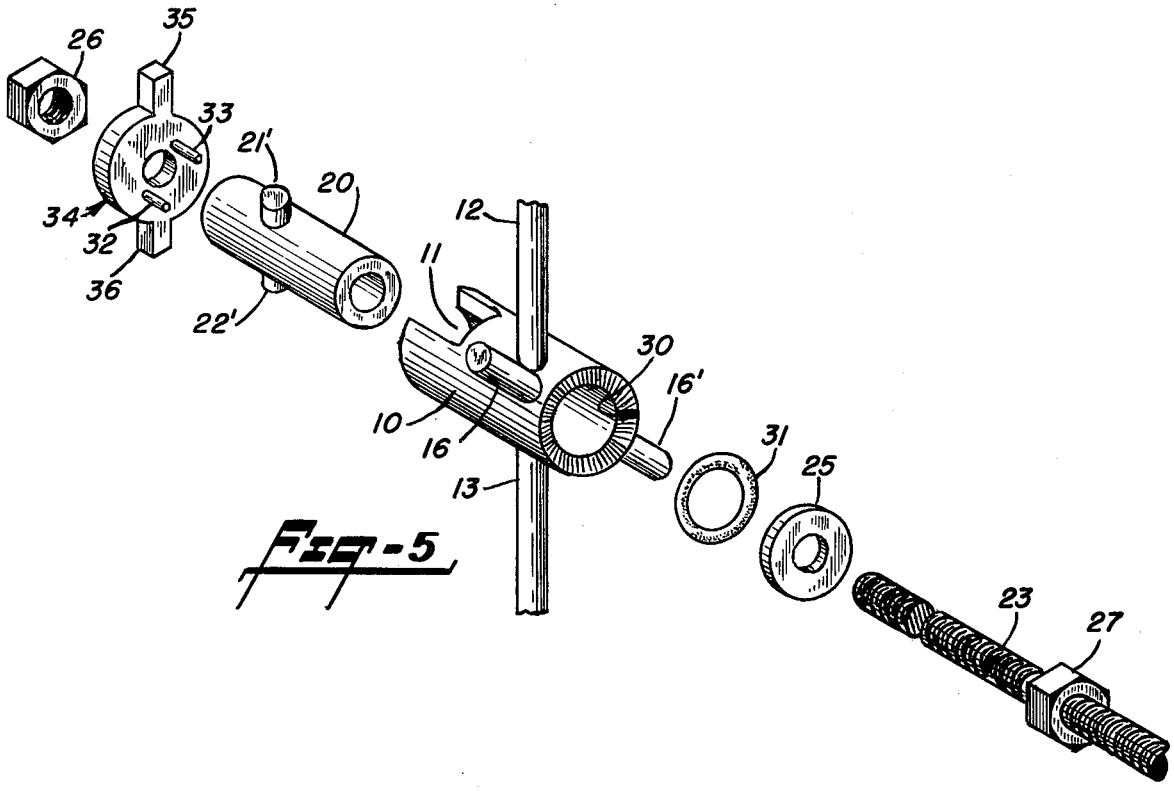
FIG. 5 is a fragmentary, exploded isometric view showing another embodiment of the invention.

Reference now is made to FIG. 5 wherein the pintles 21' and 22', carried by the hub 20, are shorter than the corresponding pintles 21 and 22 shown in FIGS. 1–4. More specifically, the pintles 21' and 22' do not protrude beyond the outer surface of the sleeve member 10 when the hub is positioned within the sleeve member. Consequently, these pins do not extend into the path of travel of the propeller blades and they function only to transmit torque to the sleeve member 10, with an angular play defined by the width of the slots formed in the end of the sleeve member. A pair of bores are formed in the end of the hub 20 for receiving the pins 32 and 33 secured to an end washer 34 provided with integral arms 35 and 36. The end washer 34, hub 20 and sleeve member 10 are assembled together in operative relationship by means of the nuts 26 and 27 threaded onto the threaded end portion of the shaft 23. In such assembly, the arms 35 and 36 project into the path of travel of the propeller blades and act in the same way as the elongated pintles shown in FIGS. 1–4.

In the illustrated forms of the invention, the hub is frictionally secured to the propeller shaft by means of nuts threaded onto a threaded end of the propeller shaft. Preferably, the hub will have an internal taper and keyway to accommodate a tapered propeller shaft and key, thereby to securely attach the hub to the shaft in accordance with conventional practice in this field. Also, although the invention has been described with specific reference to a two-bladed propeller, it will be apparent that three or four bladed propellers may be constructed to incorporate the inventive features herein disclosed. Those skilled in this art will be able to make other changes and modifications without thereby departing from the spirit and scope of the invention as recited in the following claims.

I claim:

1. A self-feathering propeller comprising, a. a tubular sleeve member having a pair of slots formed in one end thereof, b. a pair of blades, c. mounting means supporting the blades for free rotation about individual axes substantially normal to the axis of the sleeve member, d. an elongated hub adapted for attachment to a shaft, said hub supporting the said sleeve member for rotation about its axis and carrying radially-extending pintles which engage the side walls of said slots upon rotation of the hub relative to the sleeve member, e. first stop means carried by the sleeve member and limiting rotation of the blades about their axes in one direction, and f. second stop means carried by the hub and limiting rotation of the blades about their axes in the other direction.

2. The invention as recited in claim 1, wherein the said pintles extend through the said slots and constitute the said second stop means.

3. The invention as recited in claim 1, including an end washer secured to an end of said hub, said end washer having radially-projecting arms which constitute the said second stop means.

4. The invention as recited in claim 1, including drag means providing a predetermined amount of frictional resistance to rotation of the sleeve member relative to the said hub.

5. The invention as recited in claim 4, wherein said sleeve member has a chamfer formed at one end thereof, and wherein the said drag means is a resilient ring member compressed between the chamfered portion of the sleeve member and the outer surface of the hub.

6. The invention as recited in claim 1, wherein the said mounting means comprises a pair of spindles extending radially from the sleeve member, said spindles extending through longitudinal holes formed in the blades.

7. The invention as recited in claim 6 wherein the holes for the spindles are formed in the leading edge regions of the blades.

* * * * *